United States Patent [19]

Lubow

[11] 4,296,877

[45] Oct. 27, 1981

[54] NEEDLE THREADER

[76] Inventor: Allen Lubow, 300 Clinton Ave., Brooklyn, N.Y. 11205

[21] Appl. No.: 757,685

[22] Filed: Jan. 7, 1977

[51] Int. Cl.[3] ..... D05B 87/02

[52] U.S. Cl. ..... 223/99

[58] Field of Search ..... 223/99, 106, 107, 108, 223/109; 7/1 Q; 269/21

[56] References Cited

U.S. PATENT DOCUMENTS

| | | | |
|---|---|---|---|
| 92,498 | 7/1869 | Wells | 223/99 |
| 779,103 | 1/1905 | Slensby | 223/99 |
| 1,240,142 | 9/1917 | Hershberger | 223/99 |
| 1,298,501 | 3/1919 | Hawkes | 223/109 R |
| 1,641,880 | 9/1927 | Cohen | 7/1 Q |

FOREIGN PATENT DOCUMENTS

| | | | |
|---|---|---|---|
| 18003 | of 1901 | United Kingdom | 223/99 |
| 184411 | 8/1922 | United Kingdom | 223/99 |

*Primary Examiner*—George H. Krizmanich
*Attorney, Agent, or Firm*—Michael Ebert

[57] ABSTRACT

A needle threader usable by those who find it difficult to thread a needle in a conventional manner. The threader is constituted by an upstanding blade whose lower end is anchored and whose upper end or head is V-notched to loosely receive within its trough the end of a yarn or filament to be threaded. The width and thickness of the head is such as to be passable through the eye of the needle to be threaded. When the eye of the needle is brought over the head to a point below the trough of the notch, the thread is formed into a loop whose feet are clamped by the eye against the blade, and when the needle is thereafter retracted from the head, it carries the loop with it. Finally, the operator pulls the loop out of the eye and thereby threads the needle.

6 Claims, 5 Drawing Figures

Fig. 5.
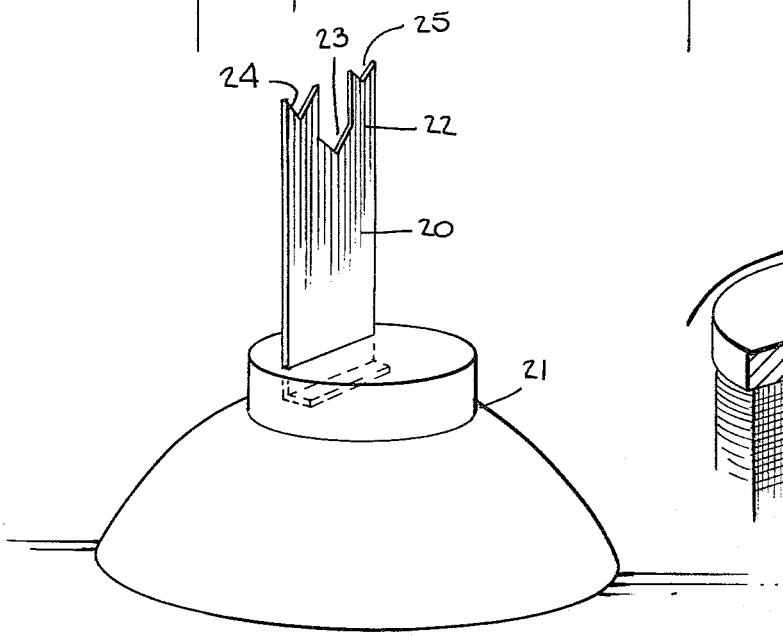
Fig. 1.
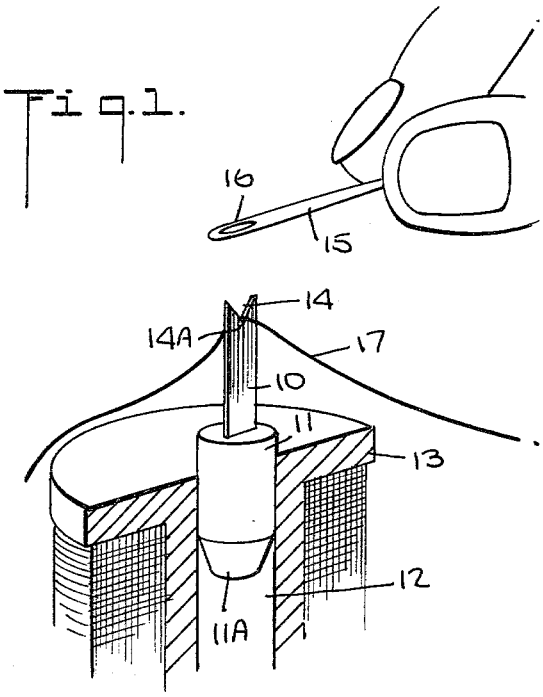
Fig. 3.
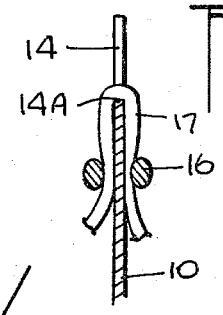
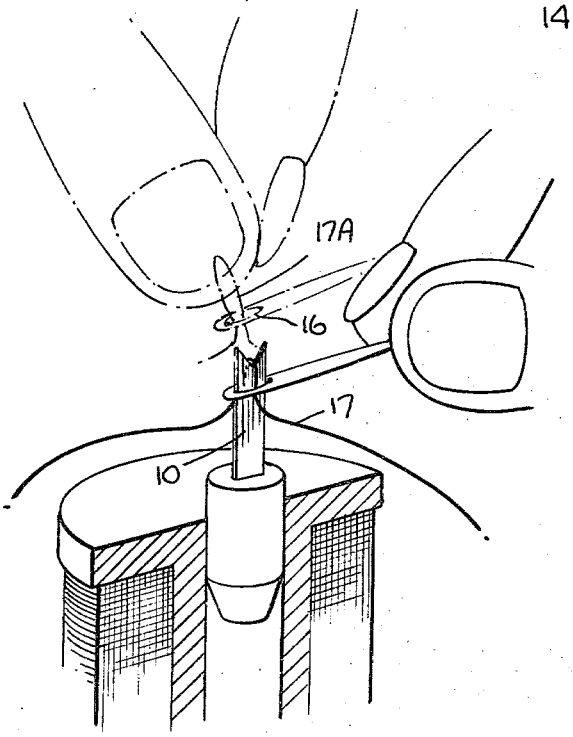
Fig. 2.
Fig. 4.
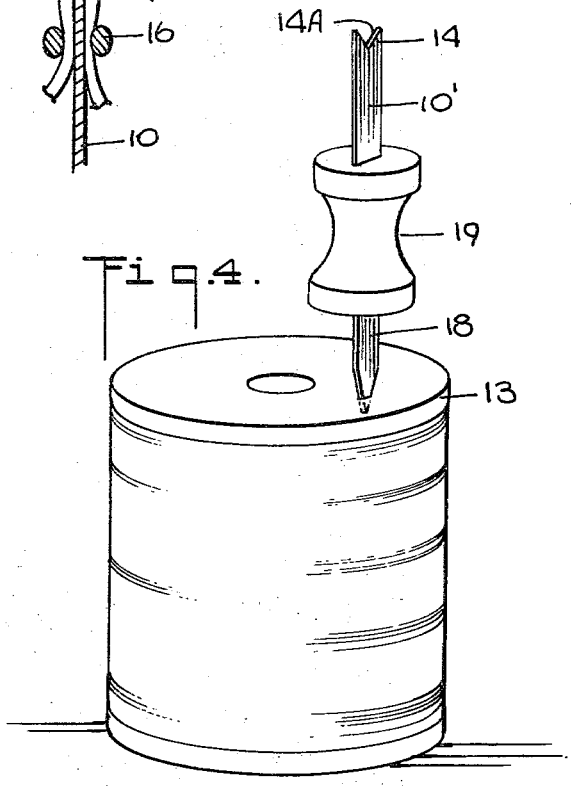

NEEDLE THREADER

BACKGROUND OF INVENTION

This invention relates generally to needle threaders to facilitate the insertion of a thread through the eye of a needle, and more particularly to a needle threader that may be used by individuals who are incapable of threading a needle in the conventional manner.

The threading of a needle by hand has always involved some degree of difficulty, for the operator is called upon to precisely orient the end of a thread with the narrow, elongated eye of the needle and to then pass the end through the eye, after which the operator is required to grasp the end to pull the thread through the eye.

Even for dextrous operators having excellent eyesight, the threading of a needle is never that easy, but with many operators whose eyesight is somewhat impaired or who are manually inept or handicapped, the threading of a needle by the conventional procedure involves a time-consuming and often vexatious operation.

Moreover, when the thread is relatively bulky, as with a yarn to be used for various types of needle work, such as embroidery, petit point or crewel, these difficulties are compounded and may altogether frustrate the operator. Thus in needlepoint, the choice of yarn and needle is governed by the size of the mesh of the canvas being used. The yarn used must be thick enough to cover the mesh, and yet the needle should be sufficiently slender to pass through the interstices of the mesh without loosening or spreading the mesh. This dictates the employment of a yarn that must be tightly compressed when it passes through the eye of the slender needle.

To facilitate needle threading, various types of devices have heretofore been proposed for this purpose, such as those disclosed in U.S. Pat. Nos. 3,838,801 and 3,840,160. But these devices dictate a two-handed procedure, one hand holding the needle while the other manipulates the device carrying the yarn through the eye of the needle. Though these devices somewhat simplify needle threading, they are not suitable for handicapped individuals, nor do these devices entirely remove the difficulties encountered in the act of threading a needle.

Also, with known needle threading devices, while these may be suitable for threading a needle having an eye of a given size, they are not workable with many other sizes. Inasmuch as needles come in a range of gauges with eyes of different size, a needle threader adapted to operate with only one or a restricted number of eye sizes has limited utility.

SUMMARY OF INVENTION

In view of the foregoing, it is the main object of this invention to provide a needle threader which requires only one hand to manipulate and which so facilitates needle threading as to be usable by an individual having poor eyesight or otherwise handicapped.

More specifically, it is an object of this invention to provide a needle threader which is anchored whereby the operator is able with one hand to bring the eye of the needle to be threaded over a V-notched head loosely supporting the end of the thread and to thereby form a loop of thread extending through the eye.

Also an object of this invention is to provide a needle threader of the above-type with a multi-section head, each notched section of which is adapted to receive an eye of a specified maximum size whereby the needle threader is usable with a large range of needle eye sizes.

Yet another object of this invention is to provide a needle threader that may be anchored securely onto a table top, or which may be anchored on a thread spool or other surface.

Briefly stated, these objects are attained in one preferred embodiment of the invention in a needle threader constituted by an upstanding blade whose lower end is anchored in a suction cup which is attachable onto a table or other flat surface, the upper end or head of the blade having a V-notch therein to loosely receive the end of a thread or yarn to be threaded.

The dimensions of the head are such as to make it passable through the eye of the needle to be threaded, so that when this needle is grasped by the hand of an operator and brought down over the head to cause the needle eye to pass thereover to a point below the trough of the notch, the thread end in the notch is formed into a loop whose feet are clamped by the eye against the blade. When the needle is thereafter retracted from the head, it carries the loop with it. Finally, the operator pulls the loop out of the eye and thereby threads the needle.

OUTLINE OF DRAWINGS

For a better understanding of the invention as well as other objects and further features thereof, reference is made to the following detailed description to be read in conjunction with the accompanying drawings, wherein:

FIG. 1 shows, in perspective, a first embodiment of a needle threader in accordance with the invention, in which the blade of the threader is anchored in a plug;

FIG. 2 shows the manner in which the threader is operated;

FIG. 3 is a longitudinal section taken through the blade of the threader to illustrate how the loop is formed;

FIG. 4 shows a second embodiment of a needle threader in accordance with the invention; and FIG. 5 illustrates a third embodiment of the invention.

DESCRIPTION OF INVENTION

First Embodiment

Referring now to FIGS. 1 to 3, there is shown a needle threader in accordance with the invention, the threader being constituted by a flat blade 10, preferably fabricated of spring steel, and a cylindrical plug 11 formed of elastomeric material. The lower end 11A of the plug is conically tapered, and the diameter thereof is such that the plug may be manually forced into the central hole 12 of a spool 13 on which the filament or yarn to be threaded is wound.

The lower end of blade 10 is anchored in plug 11, whereas the upper end or head 14 has a V-shaped notch 14A cut therein. In order to thread a needle 15 having an elongated eye 16, it is essential that the width of blade 14 be no greater than the length of the eye and that the thickness of the blade be no greater than the width of the eye of the needle to be threaded, so that the head can pass through the eye.

In threading needle 15, the end of a thread 17 is loosely laid over the notch 14A of the blade, as shown in FIG. 1, the thread end lying in the trough of the notch. Needle 15, which is grasped in one hand of the operator, is then brought down to cause eye 16 to pass over the head 14 of the blade.

As shown in FIG. 3, eye 16 is brought down to a point below the trough of notch 14A and thereby acts to form a loop of thread whose feet are clamped by the eye against the surface of the blade. Consequently, when the needle is thereafter retracted by the operator from the head of the blade, as shown in dotted lines in FIG. 2, the loop 17A which extends through eye 16 is carried thereby and may be pulled out by the operator to thereby thread the needle.

Since notch 14A is defined by a pair of pointed peaks, one has no difficulty in locating the eye with respect thereto and in bringing the eye down over the head of the blade.

Second Embodiment

In the embodiment shown in FIG. 4, the needle threader makes use of a blade 10' having a V-shaped head 14, as in the first embodiment. However, blade 10', instead of having its lower end anchored in a plug, is provided with a spear-shaped lower end adapted to pierce the wooden end disc of thread spool 13 or any other wooden surface on which the blade is to be anchored. Blade 10' extends through and is held within a cylindrical handle 19 having a concave constriction to facilitate handling. Alternatively, instead of a spear integral with the blade, the spear may take the form of a separate well-pointed pin extending from a plug in which the blade is anchored. Also, one may use a plug as in the first embodiment, which can be forced into the hole of a spool to anchor the blade, the same plug being provided with a spear so that instead of using the plug as in the anchor, the plug serves as a handle for the spear.

This needle threader is operated in the same manner described in connection with the first embodiment, the only difference being the manner in which the threader is anchored.

Third Embodiment

This embodiment, as shown in FIG. 5, includes a blade 20 whose lower end is anchored in a suction cup 21 which may be pressed down on any flat surface to secure the needle threader in place.

The head 22 of blade 20 is cut to define a deep intermediate V-notch 23 placed between a relatively shallow left V-notch 24 and a still shallower right V-notch 25. Thus the head is divided into three notch sections, the intermediate notch being intended for needle eyes whose length substantially matches the width of the blade and for use with relatively coarse yarn. The left notch section 24 has a smaller width and is appropriate for needle eyes of no greater length and for finer yarn, while the right notch section 25 has a still smaller width and is appropriate for still finer needle eyes and for very fine thread.

Thus with the multi-section blade head, the needle threader is usable with a broad range of needles, filament and yarns.

While there have been shown and described preferred embodiments of a needle threader in accordance with the invention, it will be appreciated that many changes and modifications may be made therein without, however, departing from the essential spirit thereof. Thus, for a permanent installation, the blade of the threader may be anchored in a block which can be bolted or otherwise attached to a table.

I claim:

1. A needle threader usable by individuals who find it difficult to thread a needle in a conventional manner, said needle having an alongated eye with a predetermined length and width, said threader comprising:

A. a blade whose upper end is of uniform width and thickness and is cut to define a V-notched head, across whose trough the end of the yarn or filament to be threaded is loosely laid, said blade end having a width which is less than the length of the eye and a thickness which is less than the width of the eye which makes it possible to pass the eye of the needle to be threaded over the end of the blade to a point well below the trough to cause the end of the yarn or filament to be curved into a sizable loop whose feet are clamped to the sides of the blade by the eye of the needle, whereby when the needle is thereafter retracted from the head it carries from the loop therewith, which loop can then be grasped and pulled out to thread the needle, said head being effectively divided into at least two notched sections of different width, with troughs of different depths; and B. means to anchor the lower end of the blade.

2. A threader as set forth in claim 1, wherein said anchor means is constituted by a plug of elastomeric material which is insertable in the central bore of a thread spool.

3. A threader as set forth in claim 1, wherein said anchor means is a suction cup.

4. A threader as set forth in claim 1, wherein said anchor means is constituted by a spear at the lower end of the blade which is capable of piercing a wooden surface, said blade being provided with a handle intermediate the head and the spear.

5. A threader as set forth in claim 1, wherein said blade is formed of spring steel.

6. A threader as set forth in claim 1, wherein said head has an intermediate section of greatest depth, the effective width thereof being the width of the blade, a left section of lesser depth and of lesser width, and a right section of still lesser depth and still lesser width.

* * * * *